US006758635B1

(12) United States Patent
Feng

(10) Patent No.: US 6,758,635 B1
(45) Date of Patent: Jul. 6, 2004

(54) BUOYANCY COMPENSATOR JACKET WITH WEIGHT-BEARING DEVICE QUICK RELEASE MECHANISM

(76) Inventor: Peter Feng, No. 22-10, Lane 50, Tian Muu E. Rd., Taipei (TW)

( * ) Notice: Subject to any disclaimer, the term of this patent is extended or adjusted under 35 U.S.C. 154(b) by 0 days.

(21) Appl. No.: 10/639,424

(22) Filed: Aug. 13, 2003

(51) Int. Cl.[7] ..... B63C 11/02
(52) U.S. Cl. ..... 405/186; 441/106
(58) Field of Search ..... 405/186; 441/106, 441/108, 111, 112, 113, 114, 115, 116, 117, 118, 119

(56) References Cited

U.S. PATENT DOCUMENTS 5,641,247 A * 6/1997 Seligman ..... 405/186
5,746,542 A * 5/1998 Carmichael ..... 405/186
5,803,667 A * 9/1998 Seligman ..... 405/186
5,860,769 A * 1/1999 Seligman ..... 405/186
5,913,640 A * 6/1999 Bortner ..... 405/186
5,944,450 A * 8/1999 Anderson ..... 405/186
6,030,147 A * 2/2000 Bowden ..... 405/186
6,132,142 A * 10/2000 Carmichael ..... 405/186
6,527,480 B2 * 3/2003 Angelini et al. ..... 405/186

* cited by examiner

*Primary Examiner*—Frederick L. Lagman
(74) *Attorney, Agent, or Firm*—Bacon & Thomas, PLLC

(57) ABSTRACT

A buoyancy compensator jacket with weight-bearing device quick release mechanism comprising two hook and loop fasteners and two buckles applicably distanced and attached to a weight-bearing device. Each hook and loop strip passes through respective buckles, whereupon the two ends are made to self-adhere upon contact. A crosswise binding mode of fastening facilitates securely constraining weight pockets thereof. A two-winged strip is further employed to wrap round and enclose the already bound weight pockets. A weight pouch is thus formed, the weight pockets being securely bound therein. A diver is able to remove unobstructed the weight-bearing device, thereby ensuring a quick ascent to the water surface.

5 Claims, 4 Drawing Sheets

BUOYANCY COMPENSATOR JACKET WITH WEIGHT-BEARING DEVICE QUICK RELEASE MECHANISM

BACKGROUND OF THE INVENTION (a) Field of the Invention

The present invention relates to a weight-bearing device, and more particularly pertains to the employment of two hook and loop fasteners and two buckles, with which a crosswise mode of binding facilitates securely constraining weight pockets therein. A weight pouch is thus formed, the weight pockets being securely bound therein. The present invention employs a configuration that reciprocally collocates effecting inflation and deflation of air and equipment comprising a weight pouch enclosed within a weight-bearing device, thereby allowing a diver steady control of the rise and fall or maintaining of a desired depth within the water. In emergency situations, the weight-bearing device can be quickly released from the jacket, thereby allowing expedient rise to the water surface.

(b) Description of the Prior Art

A conventional buoyancy compensator jacket is typically equipped with back and side panels wherein gas cylinders are disposed. Inner portions of the jacket are configured with airbags. FIG. 1 shows one end of an air pipe 102 connected to a gas cylinder, the other end joins an air pipeline 100 connected to a gasbag. One, end of the air pipeline is connected to an air release button 101, and one end of the air pipe 102 is actuated with an air pipeline button 103. Separately attached to the left and right panels of the jacket are waist pockets 200, upon which ate pockets 300 separately sewn thereon.

FIG. 2 shows a single open-ended pocket opening 301 of a pocket 300 designed to accommodate a pouch 400 containing weights A therein. A hook and loop fastener 401 at the open-end of the pouch 400 and a hook and loop fastener 302 attached to the pocket 300 are configured to self-adhere upon contact of their two ends, thereby securing the pouch 400. A pull-ring 402 is firmly sewn to the pouch 400.

In emergency situations at sea, a diver must press an air pipeline button 103 in order to channel air in a gas cylinder to a gasbag attached to the diver's jacket, whereupon buoyancy is increased and a quick rise to the water surface is ensured. It is further necessary for the diver to pull strongly on a pull-ring 402 of a pouch 400, thereby disengaging a hook and loop strip 401 of the pouch 400 from a hook and loop strip 302 of the pocket 300. The pouch 400 is then discarded, thereby lightening the weight of the diver and ensuring a quick ascent to the water surface. Another situation may occur upon the diver going ashore or re-boarding a ship, whereupon the diver promptly tears apart the hook and loop fastener, thereby loosening free the pouch 400.

Notwithstanding, it is necessary for the weights A disposed in the pouch 400 to be adjusted in size and quantity to accommodate different requirements of the user. However, the conventional pouch 400 is a hollow pocket-shape defined to contain weights A. It is not possible to completely affix the weights A in a set configured position (see FIG. 2), thus the weights A become displaced or loose in the pouch 400. This situation results in the diver unable to easily maintain balance when rising, falling or sustaining a desired depth in the water. Moreover, upon discarding the pouch 400 when resurfacing, because the weights A have become dislodged, the pouch 400 is obstructed or made difficult to remove thereof.

The inventor of the present invention has referenced the following U.S. Pat. Nos. 6,527,480, 6,487,761, 4,881,492, 5,913,640, 5,311,833 & 5,027,471

SUMMARY OF THE INVENTION

The primary objective of the present invention is to provide a weight-bearing device employing two hook and loop fasteners and two buckles attached at an applicably distance thereon. A crosswise mode of binding facilitates securely constraining weight pockets of the weight-bearing device therein. A two-winged strip is further employed to wrap round and enclose the already bound weight pockets. A weight pouch is thus formed, the weight pockets being securely bound therein. Stability of the buoyancy compensator jacket is thereby enhanced.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
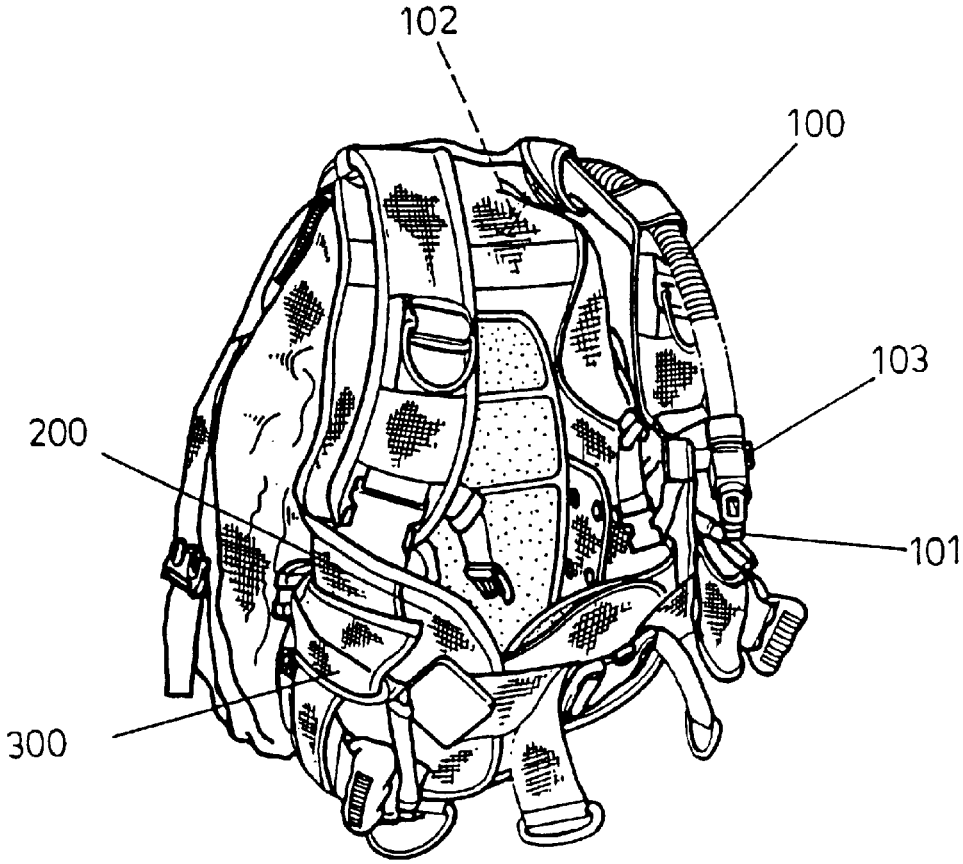
FIG.1 (PRIOR ART)
FIG. 1 shows an overall view of a buoyancy compensator jacket.
Figure 2:
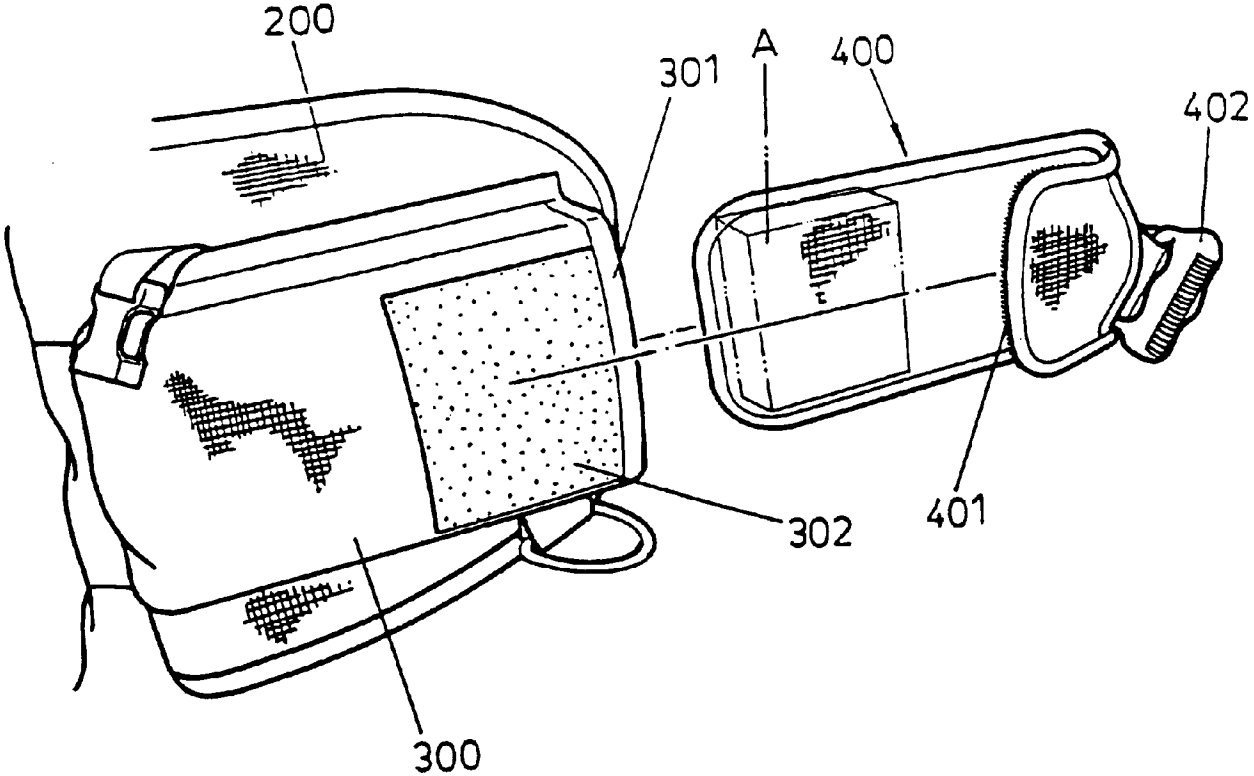
FIG.2 (PRIOR ART)
FIG. 2 shows an exploded elevational view of a conventional weight pouch and pocket.

FIG. 1 shows an air pipeline 100, an air release button 101, an air pipe 102, air pipeline button 103, left and right waist pockets 200 and pockets 300.

Figure 3:
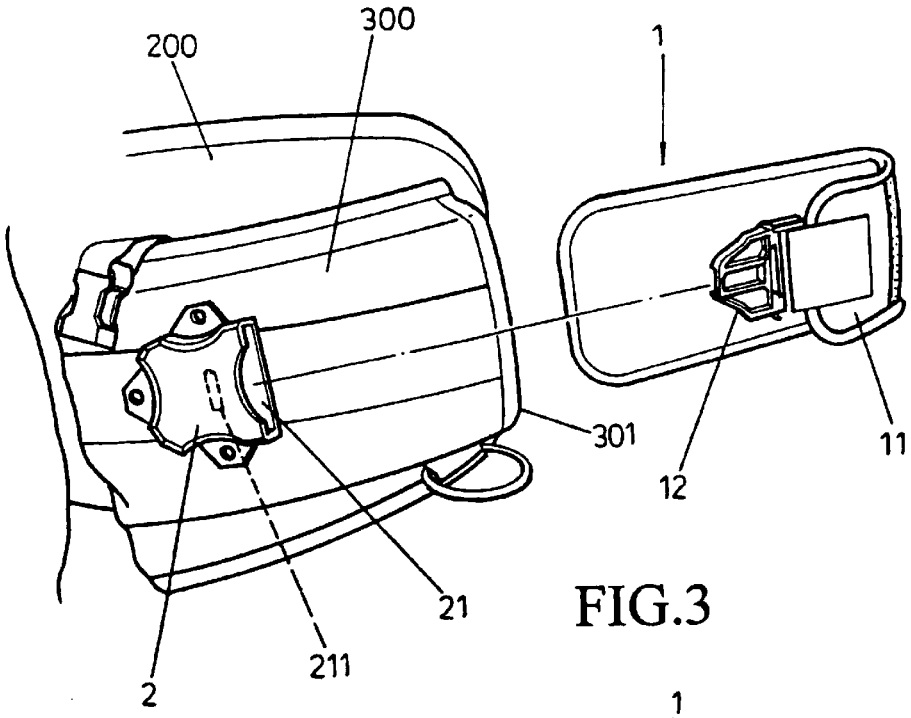
FIG. 3 shows an exploded elevational view of a pocket and weight-bearing device of the present invention.

Referring to FIG. 3, a pocket 300 is separately sewn to each of the left and right waist pockets 200 thereon. A pocket opening 301 of the pocket 306 is configured to contain a weight-bearing device 1 therein. A male member 12 is affixed to one end of an outer band 11 of the weight-bearing device 1. An inner edge of the frontal side of the male member 12 is designed with a tapered hook 121 (see FIG. 4). A female member 2 is configured at one end of the pocket 300 thereof. A fastener opening 21 of the female member 2 is designed to engage with the male member upon coupling, whereupon the hook 121 clasps firmly a catch 211 of the fastener opening 21 of the female member thereof.

A pull-ring 13 is attached at one end of an outer band 11 of the weight-bearing device 1, and is configured to facilitate disengaging the catch 211 of the female member 2 upon a diver pulling strongly on the pull-ring 13, thereby separating the weight-bearing device 1 from the pocket 300. Under emergency situations, upon disengaging the weight-bearing device 1, the diver is able to immediately discard the weight-bearing device 1, thereupon quickly rising to the water surface for help.

Figure 4:
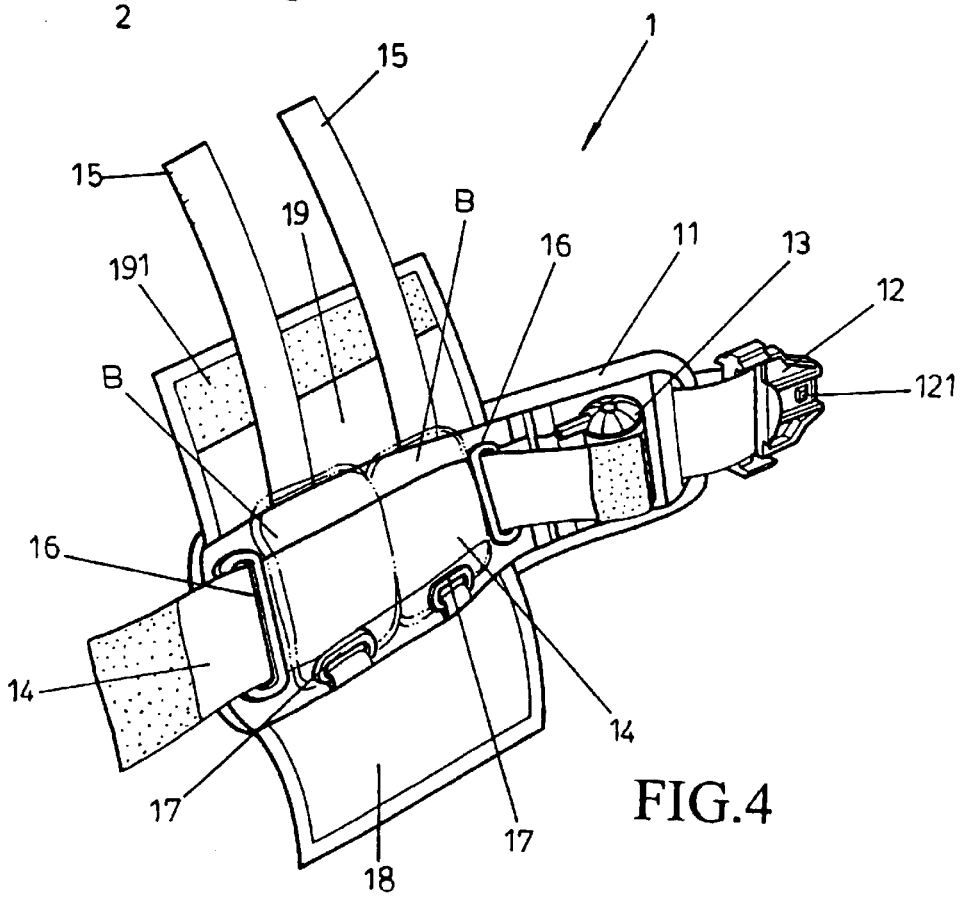
FIG. 4 shows an unfolded view of a pocket and weight-bearing device of the present invention.
Figure 5:
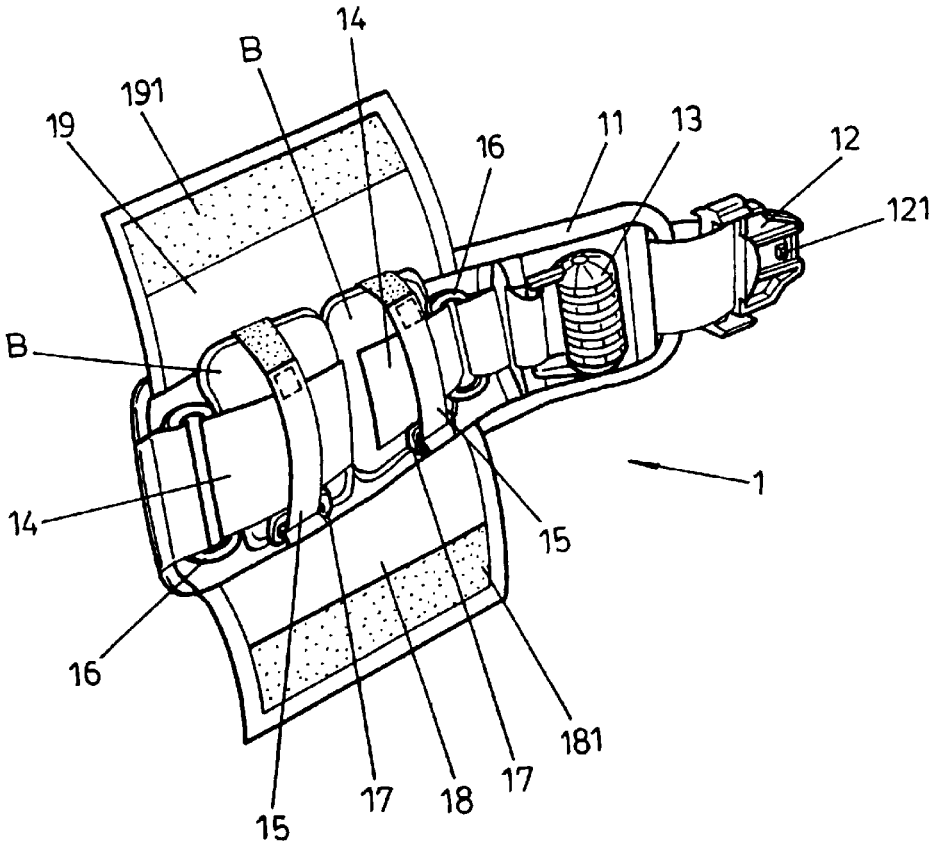
FIG. 5 shows a partially folded view of a pocket and weight-bearing device of the present invention.
Figure 6:
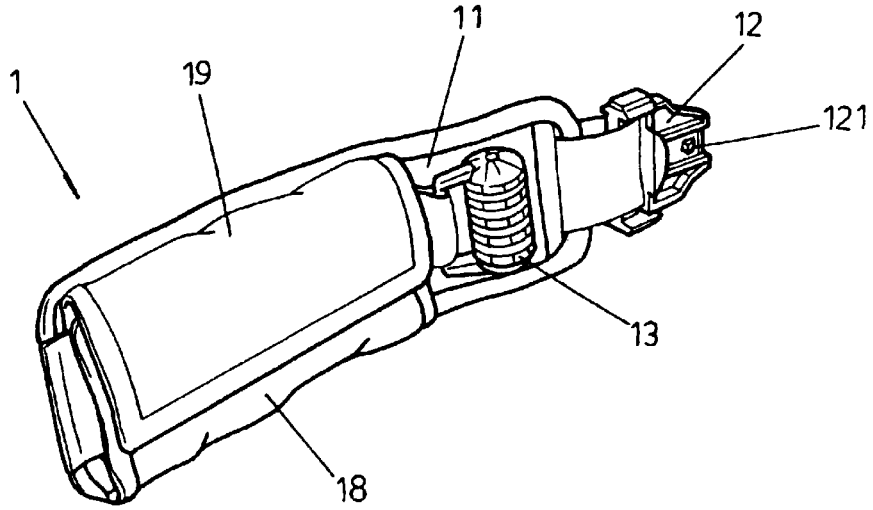
FIG. 6 shows a composite view of a pocket and weight-bearing device of he present invention.

The Preferred Embodiments of the Present Invention Include:

A weight-bearing device 1 configured to bind one or more weight pockets B. FIG. 4 depicts the weight-bearing device 1 holding two weight pockets B as an exemplary embodiment: Each pocket B of the weight-bearing device 1 comprises two hook and loop fasteners 14, 15 and two buckles 16, 17 attached at applicable distances. Upon the comparatively wider of the hook and loop fasteners 14 being passed through the respective buckles 16, the two ends of the hook and loop fastener 14 are made to self-adhere upon contact. Thereupon, the comparatively narrower hook and loop fastener 15 is passed through the respective buckle 17, and the two ends are made to self-adhere upon contact. The weight pockets B are thereby bound in a crosswise fashion (see FIG. 5).

Two-wing strips 18, 19 of the weight-bearing device 1 are wrapped round the weight pockets B, thereby tightly binding hook and loop fasteners 14, 15 and enclosing them therein. Whereupon the two ends of the hook and loop fasteners 181, 191 are made to self-adhere upon contact, thereby securing the whole binding. An extremely secure binding of the weight pockets is thus formed, defining a weight pouch thereof.

In conclusion, the present invention employs two hook and loop fasteners and two buckles, with which weight pockets are bound securely by means of a crosswise binding fashion. The present invention further employs a two-wing strip to wrap tightly and enclose the weight pockets, accomplishing a double-layered constraint of the weight pockets therein, as well as preventing the weight pockets from displacement or becoming dislodged when disposed in the weight-bearing device.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A buoyancy compensator jacket with weight-bearing device quick release mechanism comprising an air pipeline, an air release button, an air pipe, air pipeline button, two waist pockets and two pockets, wherein the two waist pockets are separately affixed to the pockets thereon; the pocket openings of the pockets are configured to contain a weight-bearing device holding weights therein; a male member defined with a hook securely affixed to one end of an outer band of the weight-bearing device thereof; a female member is securely affixed to one end of a pocket, whereby the female member is configured to engage with the male member, characterized in that:

a weight-bearing device holding at least one weight is configured with two hook and loop fasteners and two buckles attached at applicable distances thereon; wherein, one hook and loop fastener passes through buckles, whereupon the two ends of the hook and loop fastener are made to self-adhere upon contact; the other hook and loop fastener passes through the other buckles, whereupon the two ends are made to self-adhere upon contact; the weight pockets are thereby securely bound in a crosswise fashion; a two-wing strip of the weight-bearing device wraps round the weight pockets, whereby tightly enclosing the weight pockets therein.

2. The weight-bearing device according to claim 1, wherein the hook and loop fasteners attached to the weight-bearing device can be replaced by a fastening device, whereby a secure connection is accomplished through mutual contact of their two ends thereof.

3. A weight-bearing device according to claim 1, wherein the hook and loop fasteners attached to two wing-fasteners mutually adhere, thereby securing a connection.

4. A weight-bearing device according to claim 3, wherein the hook and loop fasteners attached to a two-wing strip can be replaced by a fastening device, whereby a secure connection is accomplished though mutual contact of their two ends thereof.

5. A weight-bearing device according to claim 1, wherein a catch is defined within a pocket of a female member; a hook defined on a male member of the weight-bearing device is hooked firmly on the catch thereof.

* * * * *